US007007839B1

(12) United States Patent
Piccolo

(10) Patent No.: US 7,007,839 B1
(45) Date of Patent: Mar. 7, 2006

(54) MAIL DELIVERY INDICATOR DEVICE AND METHOD

(76) Inventor: Roberto Piccolo, 15 N. Morris St., Dover, NJ (US) 07801

( * ) Notice: Subject to any disclaimer, the term of this patent is extended or adjusted under 35 U.S.C. 154(b) by 0 days.

(21) Appl. No.: 10/789,719

(22) Filed: Feb. 27, 2004

(51) Int. Cl.
*B65D 91/00* (2006.01)

(52) U.S. Cl. ..... 232/35

(58) Field of Classification Search ..... 232/35, 232/34, 17; 116/215; D99/29
See application file for complete search history.

(56) References Cited

U.S. PATENT DOCUMENTS

| | | | | | |
|---|---|---|---|---|---|
| 2,609,787 | A | * | 9/1952 | Lawson | 232/35 |
| 2,815,167 | A | * | 12/1957 | Bailes et al. | 232/35 |
| 3,596,631 | A | * | 8/1971 | Sutton | 232/35 |
| 3,904,108 | A | * | 9/1975 | File | 232/35 |
| 3,958,752 | A | * | 5/1976 | Pieszchala | 232/35 |
| 4,262,839 | A | | 4/1981 | Wisniewski | |
| D278,469 | S | * | 4/1985 | Ross | D99/29 |
| 4,708,286 | A | | 11/1987 | Norris | |
| 4,728,028 | A | * | 3/1988 | Barnes et al. | 232/35 |
| 4,821,953 | A | * | 4/1989 | Poloha | 232/35 |
| 4,925,090 | A | * | 5/1990 | Barrett | 232/34 |
| 5,560,540 | A | * | 10/1996 | Amendola | 232/35 |
| 5,884,838 | A | * | 3/1999 | Rose | 232/35 |
| 6,155,482 | A | * | 12/2000 | Perry | 232/35 |
| 6,318,629 | B1 | * | 11/2001 | Anderson | 232/35 |
| 6,425,521 | B1 | | 7/2002 | Cooper | |

* cited by examiner

*Primary Examiner*—William L. Miller

(57) ABSTRACT

A mail delivery indicator device and method for providing a visual indication of the occurrence of a mail delivery. The mail delivery indicator device and method includes a coupling structure used for selectively securing the device to the conventional mailbox; an elongate member having a first end operationally coupled to the coupling structure, a second end, and a medial portion which is positionable between portions of a latching mechanism used to selectively secure a door of the mailbox in a closed position; and an indicator operationally coupled to the second end of the elongate member.

5 Claims, 2 Drawing Sheets

MAIL DELIVERY INDICATOR DEVICE AND METHOD

BACKGROUND OF THE INVENTION

1. Field of the Invention

The present invention relates to mailbox indicator devices and more particularly pertains to a new mail delivery indicator device and method for providing a visual indication of the occurrence of a mail delivery.

2. Description of the Prior Art

The use of mailbox indicator devices is known in the prior art. Illustrative examples include U.S. Pat. No. 4,262,839; U.S. Pat. No. 4,708,286; and U.S. Pat. No. 6,425,521.

While these devices fulfill their respective, particular objectives and requirements, the need remains for a device and method that provides a visual indication, which is readily observed at a distance.

SUMMARY OF THE INVENTION

While receiving mail at one's home is truly a convenient and desirable service, there are some drawbacks associated with using mail boxes to receiver postal deliveries. Foremost is the fact that one can't know if there is anything in a rural or free standing mail box without looking inside. This means that consumers, on the many days where no mail is delivered to them, waste the time and effort required in checking their mail boxes. Inclement weather or a box located on a busy road or rural highway are other concerns that make checking an empty mail box additionally frustrating.

This product is a specially designed device which attaches to the consumers existing mail box and acts to trigger a visual notification each time the mail box door is opened. Visual notification is made by means of a circular plastic medallion approximately the size of a silver dollar. This medallion would be attached to one end of a length of nylon cord approximately twenty four inches (24") long and one eighth inch (⅛") in diameter. On the opposite end of this length of cord would be plastic clip used to attach the device to the red flag on the side of the mail box.

Use of the product would be very simple and straightforward. First, the consumer would attach the device to the mail box flag using the plastic clip, allowing the medallion to hang suspended alongside the box. Next, the cord would be raised up along the side of the mailbox and over its top, passing in between simple door latching mechanism on the box, and then continuing over the top and down along the opposite side of the box. In this manner, when the mailman opened the door to place postage inside the box, the cord would be forced from between the door latch. This action would cause the medallion to dangle suspended form the mail box flag, a visual notice signifying that the box has been visited. After removing mail from the box the consumer would reset the device for use the following day.

The product would offer a number of important benefits and advantages. Foremost, by providing a visual indication that mail has been delivered, consumers would save the time and effort spent checking an empty mail box. The advantages of not having to physically go to the box unless mail is present would only be enhanced on foul weather days or at any mail box located near a high traffic area. Another important benefit is related to this product's basic design. The round, flat surface of the medallion would provide an ideal space for printed or graphic advertising messages. Real estate agencies, sports teams, automobile dealers and most any other business or civic concern would possibly find this medium a novel means of getting their message out to prospective customers. Selling this available space on the medallions could prove a lucrative enterprise in itself.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
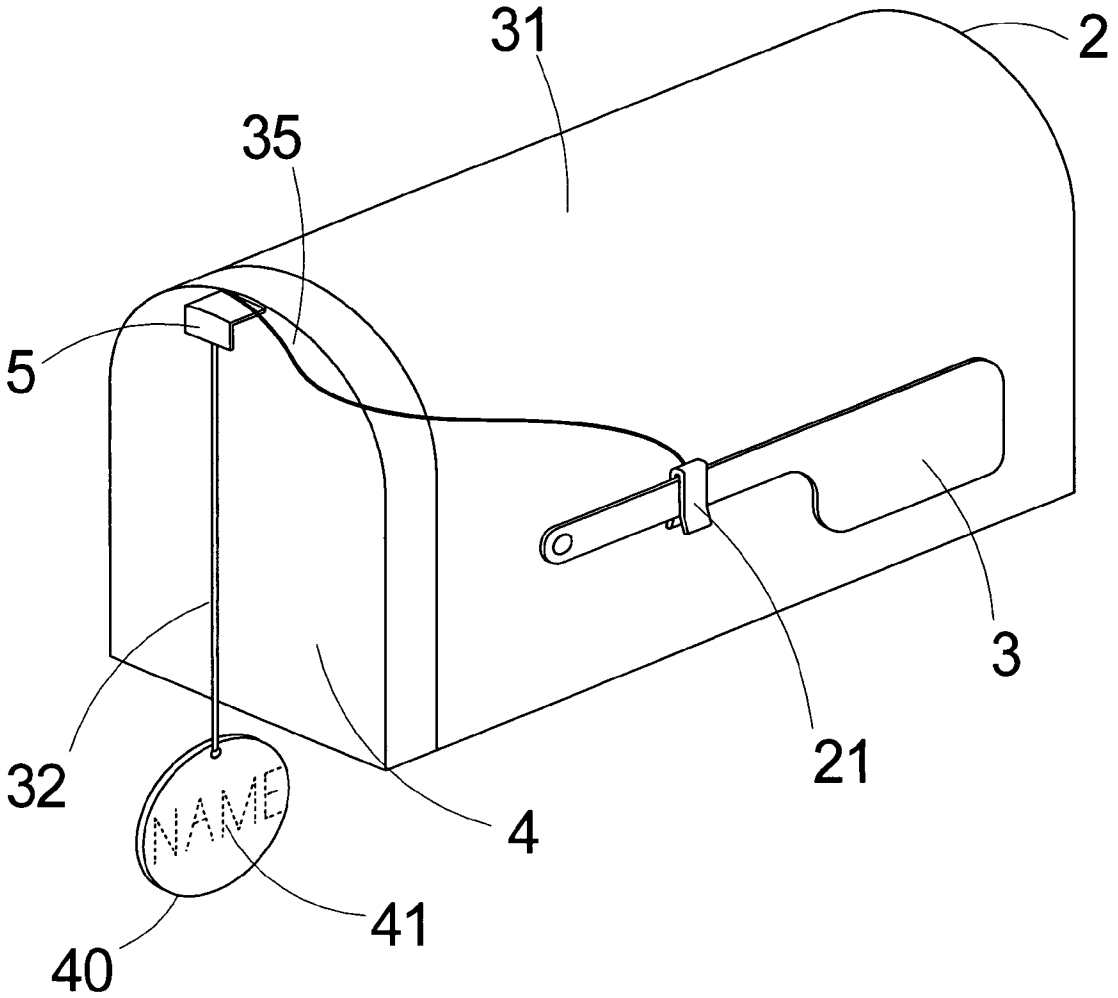
FIG. 1 is a schematic perspective view of a new mail delivery indicator device and method in use according to the present invention.
Figure 2:
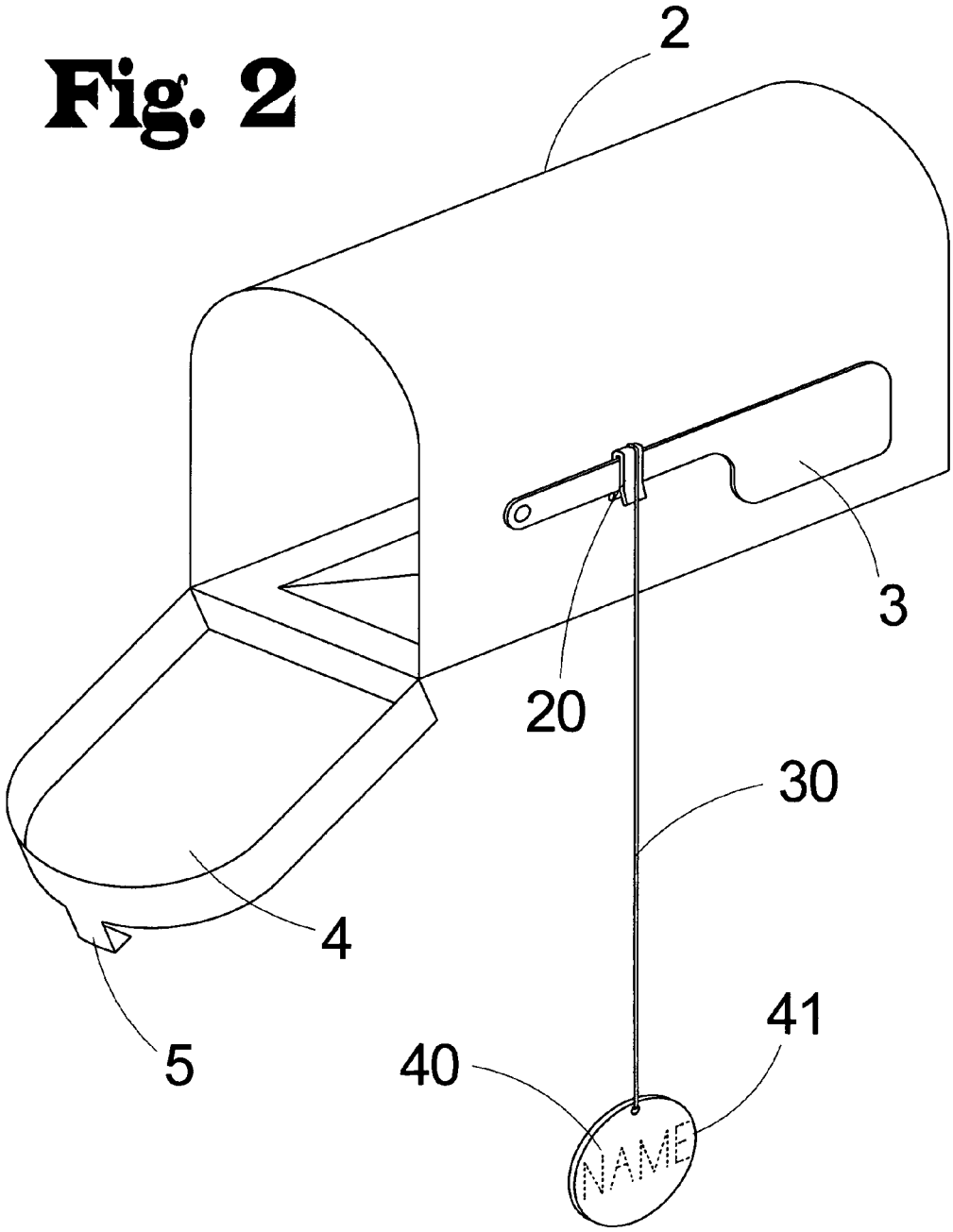
FIG. 2 is a schematic perspective view of the present invention.

With reference now to the drawings, and in particular to FIGS. 1 through 2 thereof, a new mail delivery indicator device and method embodying the principles and concepts of the present invention and generally designated by the reference numeral 10 will be described.

As best illustrated in FIGS. 1 through 2, the mail delivery indicator device and method 10 generally comprises a coupling means 20, an elongate member 30, and an indicator 40.

The coupling means 20 is used for selectively securing the device 10 to the conventional mailbox 2.

In at least one embodiment, the coupling means 20 further comprises a clip 21 designed for selectively coupling to a flag 3 of the conventional mailbox 2.

The elongate member 30 has a first end 31 and a second end 32. Preferably, the first end 31 is operationally coupled to the coupling means 20. The elongate member 30 is preferably flexible. The elongate member 30 includes a medial portion 35, which is positionable between portions of a latching mechanism 5 used to selectively secure a door 4 of the mailbox 2 in a closed position.

In an embodiment, the elongate member 30 is a nylon cord having a diameter of approximately $\frac{1}{8}^{th}$ inch and a length of approximately twenty-four inches.

Preferably, the indicator 40 is operationally coupled to the second end 32 of the elongate member 30. The indicator 40 is positionable to provide a visual indication of a mail delivery.

In a further embodiment, the indicator 40 is substantially disc shaped, with a diameter in the range between one half and four inches inclusive.

In still a further embodiment, the indicator 40 has an indicia 41 positioned on at least a first surface of the indicator 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a mailbox having an enclosure including a floor wall, an upper wall arched over the floor wall, and a door pivotally mounted on said floor wall to selectively close an end of said upper wall, said mailbox including a flag pivotally mounted on said upper wall to pivot between an upright position and an inclined position, said mailbox having a latching mechanism for selectively securing a door of the mailbox in a closed position;

a device for providing a visual indication of a mail delivery for use with said mailbox, said device comprising:

a coupling means selectively securing said device to the flag of said mailbox, an elongate member having a first end and a second end, said first end being attached to said coupling means, said elongate member being flexible, said elongate member having a medial portion positionable over a portion of said latching mechanism; and an indicator operationally coupled to said second end of said elongate member, said indicator being positionable to provide a visual indication of a mail delivery, said indicator being substantially disc shaped, said indicator having a diameter in the range between one half and four inches inclusive, said indicator having an indicia positioned on at least a first surface of said indicator;

wherein said coupling means further comprises a clip removably coupled to the flag of said mailbox, the clip having a substantially U-shaped configuration with a base portion and a pair of arm portions extending from said base portion in a substantially parallel relationship to each other to pinch a portion of the flag inserted therebetween.

2. The combination of claim 1, wherein said elongate member being a nylon cord.

3. The combination of claim 1, wherein said elongate member having a diameter of approximately $1/8^{th}$ inch and a length of approximately twenty four inches.

4. The combination of claim 1, wherein said elongate member comprises a nylon cord, said elongate member having a diameter of approximately $1/8^{th}$ inch and a length of approximately twenty four inches.

5. A method of indicating the occurrence of a mail delivery, comprising:

providing an indicating device having a coupling means for selectively securing said device to a mailbox; an elongate member having a first end and a second end, said first end being operationally coupled to said coupling means, said elongate member being flexible, said elongate member having a medial portion; and an indicator operationally coupled to said second end of said elongate member;

attaching said coupling means to a flag portion of the mailbox;

opening a door of the mailbox;

positioning said medial portion of said elongate member between portions of a latching mechanism for selectively securing the door of the mailbox in a closed position;

closing the door of the mailbox and engaging the medial portion of said elongate member in the latching mechanism, said elongate member holding said indicator in a first position; and waiting for a mail carrier to open the door of the mailbox thereby releasing said elongate member and moving said indicator to a second position.

* * * * *